US007011435B1

(12) United States Patent
Blaymore

(10) Patent No.: US 7,011,435 B1
(45) Date of Patent: Mar. 14, 2006

(54) APPARATUS FOR RETROFITTING A REMOTE CONTROL DEVICE TO A STAGE LIGHTING FIXTURE

(76) Inventor: Lee M Blaymore, 3550 Woodward St., Oceanside, NY (US) 11572-4531

( * ) Notice: Subject to any disclaimer, the term of this patent is extended or adjusted under 35 U.S.C. 154(b) by 150 days.

(21) Appl. No.: 10/743,186

(22) Filed: Dec. 22, 2003

(51) Int. Cl.
*F21V 19/00* (2006.01)
*F21V 21/00* (2006.01)

(52) U.S. Cl. ..... 362/382; 362/419; 362/428; 362/371

(58) Field of Classification Search ..... 362/382, 362/406, 418, 419, 428, 427, 429, 457, 371; 340/825.69, 825.72
See application file for complete search history.

(56) References Cited

U.S. PATENT DOCUMENTS

| | | | | |
|---|---|---|---|---|
| 2,817,005 | A | 12/1957 | Cameron | |
| 3,110,815 | A | 11/1963 | Sturm | |
| 3,287,552 | A | 11/1966 | Drandell | |
| 3,783,263 | A | 1/1974 | Cruse | |
| 4,598,345 | A | 7/1986 | Kleeman | |
| 4,712,167 | A | 12/1987 | Gordin et al. | |
| 4,890,207 | A | 12/1989 | Jones | |
| 5,031,082 | A * | 7/1991 | Bierend | 362/233 |
| 5,506,715 | A | 4/1996 | Zhu | |
| 5,584,560 | A | 12/1996 | Gosswiller et al. | |
| 6,607,285 | B1 * | 8/2003 | Citron et al. | 362/250 |
| 2005/0047142 | A1 * | 3/2005 | Lui | 362/275 |

FOREIGN PATENT DOCUMENTS

| | | |
|---|---|---|
| CA | 1 300 109 | 5/1992 |
| GB | 2 177 817 | 1/1987 |

* cited by examiner

*Primary Examiner*—Sandra O'Shea
*Assistant Examiner*—Sharon Payne
(74) *Attorney, Agent, or Firm*—Michael I Kroll

(57) ABSTRACT

A remote control device for spotlights 12 and retrofitting a remote control device to an existing light fixture for repositioning the horizontal axis and the vertical axis of a standard stage lighting fixture 12 such as a par can, a Fresnels, an ellipsoidal and the like. Using the device, user is permitted to make such adjustments from a remote location at any time either before or during a performance. Each unit may include a remote control device 22 that sends a unique data signal 20 to which that specific light will respond or may be adapted so that one remote control device effects a plurality of lights simultaneously. A vertical drive mechanism 32 will control the vertical movement of lamp 24 and a horizontal drive mechanism 60 will control the horizontal movement of the lamp 24. Both the vertical 32 and horizontal 60 drive mechanisms have receivers 28 for receiving the transmitted signal 20 from the remote control 22.

10 Claims, 7 Drawing Sheets

APPARATUS FOR RETROFITTING A REMOTE CONTROL DEVICE TO A STAGE LIGHTING FIXTURE

BACKGROUND OF THE INVENTION

1. Field of the Invention

The present invention relates generally to remote control devices for spotlights and, more specifically, to a means for retrofitting a remote control device for repositioning the horizontal axis and the vertical axis of a standard stage lighting fixture such as a par can, a fresnel, an ellipsoidal and the like. The present invention permits the user to make such adjustments from a remote location at any time either before or during a performance. Each unit may include a remote control device that sends a unique data signal to which that specific light will respond or the present invention may be adapted so one remote control device effects a plurality of lights simultaneously.

2. Description of the Prior Art

There are other remote devices for adjusting spotlights. Typical of these is U.S. Pat. No. 2,817,005 issued to C. E. Cameron on Dec. 17, 1957.

A patent was issued to W. Sturm on Nov. 12, 1963 as U.S. Pat. No. 3,110,815. Yet another U.S. Pat. No. 3,287,552 was issued to J. Drandell on Nov. 22, 1966 and J. Kleeman was issued U.S. Pat. No. 4,598,345 on Jul. 1, 1986. W. M. Cruse was issued U.S. Pat. No. 3,783,263 on Jan. 1, 1974 and on Dec. 8, 1987 M. K. Gordin, et al. was issued U.S. Pat. No. 4,712,167.

D. C. Jones was issued U.S. Pat. No. 4,890,207 on Dec. 26, 1989 and U.S. Pat. No. 5,031,082 was issued to G. D. Bierand on Jul. 9, 1991. U.S. Pat. No. 5,506,715 was issued to J. S. Zhu on Apr. 9, 1996. U.S. Pat. No. 5,584,560 was issued to E. W. Gosswiller on Dec. 17, 1996.

M. Bertozzi was issued U. K. Patent No. GB 2 177817 A on Jan. 28, 1987 and Canadian Patent no. 1,300,109 was issued to D. C. Jones on 5 May 1992.

U.S. Pat. No. 2,817,005

Inventor: C. E. Cameron

Issued: Dec. 17, 1957

In a spotlight, a base, a head mounted on said base for rotation about a vertical axis, a lamp housing mounted on said head for rocking movement about a horizontal axis, a plurality of motion transmitting pins in fixed relation to said housing and extended parallel to and disposed in arcuate series about said horizontal axis, said base having a non-circular guide passage therein along said vertical axis, an operating plunger vertically slidable in said passage, and effective when rotated to turn said head about said vertical axis, said plunger having angularly disposed segmental slots therein effective to snugly and slidably engage said pins in succession as said plunger is moved axially to impart rocking movement to said housing about said horizontal axis, and spring means acing in a direction perpendicular to said pins and laterally on said plunger to hold the same laterally on said plunger to hold the same laterally against a side surface of said passage and thereby prevent rocking vibration of said housing.

U.S. Pat. No. 3,110,815

Inventor: Walter Sturm

Issued: Nov. 12, 1963

An operating lamp comprising a lamp casing pivotable about a first, a second and a third axis, a plurality of lamps in said casing, a first, a second and a third reversible motor for displacing the lamp casing about said axes, a control light emitter forming a separate unit, first, second and third photoelectric means associated with said motors, operating said motors to displace said lamp casing whenever the optical axis of said lamp casing substantially points in a direction other than towards the optical axis of said control light emitter, a first, second, and third pair of photoelectric cells in said photoelectric means, with each pair being symmetrically disposed relative to the central axis of said lamp casing, with one of said cells of said pairs causing said motor to turn clockwise, and the respective other one of said cells of said pairs causing said motor to turn counter clockwise.

U.S. Pat. No. 3,287,552

Inventor: Jack Drandell

Issued: Nov. 22, 1966

A remote controlled lighting system for projecting light into the mouth of a patient reclining in a dentist chair comprising a housing, an elongated rack having a pair of openings, two pairs of light units wherein each unit is capable of projecting a beam of light, means connected to the rack positioning each light unit adjacent a respective opening with each beam of light projectable therethrough, the distance between the openings of each pair being substantially equal, linkage means connected at one end to an output shaft of said motor at a location eccentric the longitudinal axis of the shaft and at an opposite end of said motor, means connected to said motor for limiting its movement in both directions, a pair of push button switches connected to said motor for energizing said the motor in opposite directions.

U.S. Pat. No. 3,783,263

Inventor: William Marion Cruse

Issued: Jan. 1, 1974

A radio-controlled TV or movie studio spotlight or general purpose illumination instrument; two joy sticks, one for the pan or tilt, the other one for the dim or iris adjustments and settings, respectively, are installed on a panel of a 4-channel radio transmitter accessible for manual actuation to provide the respective commands for a four-channel radio receiver and thereby for the remote control of the lighting equipment functions.

U.S. Pat. No. 4,598,345

Inventor: Jeff Kleeman

Issued: Jul. 1, 1986

A mobile, variable effect lighting device including a mobile base platform to which is mounted an adjustably positionable and extendable boom. A lighting array frame having one or more luminaire assembly units is hingeably mounted to the outer end of the boom. Each luminaire assembly unit, in turn, is individually vertically and horizontally adjustable. Appropriate motor or power mechanisms are operably connected to the luminaire assembly units, the lighting array frame, and the boom to allow automatic and remote adjustability and operation of these components. A control circuitry is operatively connected to the luminaire assembly units and the motor or power mechanisms and has a control unit by which a remote operator can control operation of luminaire assembly units, and their orientation with respect to a target area.

U.S. Pat. No. 4,712,167

Inventor: Myron K. Gordin, et al.

Issued: Dec. 8, 1987

A mobile, variable effect lighting device including a mobile base platform to which is mounted an adjustably positionable and extendable boom. A lighting array frame having one or more luminaire assembly units is hingeably mounted to the outer end of the boom. Each luminaire assembly unit, in turn, is individually vertically and horizontally adjustable. Appropriate motor or power mechanisms are operably connected to the luminaire assembly units, the lighting array frame, and the boom to allow automatic and remote adjustability and operation of these components. A control circuitry is operatively connected to the luminaire assembly units and the motor or power mechanisms and has a control unit by which a remote operator can control operation of luminaire assembly units, and their orientation with respect to a target area.

U.S. Pat. No. 4.8900.207

Inventor: Danny C. Jones

Issued: Dec. 26, 1989

A remote controlled spotlight system having a pair of spotlights on the ends of a horizontal shaft extending through a housing. A vertical shaft extends out of the housing for mounting purposes. An electric motor in the housing rotates the horizontal shaft about its longitudinal axis to aim the spotlights up or down. A second electric motor in the housing rotates the housing about the longitudinal axis of the vertical shaft to aim the spotlights left or right. The electrical motors are remotely controlled. An electrical power cord extends through the bore of the horizontal shaft, out through a hole in the horizontal shaft, and winds around the horizontal shaft at least twice. The cord then winds around the vertical shaft at least twice, and then passes through the bore of the vertical shaft to a power source.

U.S. Pat. No. 5,031,082

Inventor: Gary D. Bierend

Issued: Jul. 9, 1991

A remotely controlled security lighting system (10) that utilizes the common utility power lines of a building to provide communication between a master control/transmitting unit (12) and a plurality of remote light/receiving units (50). The unit (12) includes a light selector switch (16) that allows a particular light to be selected, a light power switch (18) that powers the selected light and a joystick (20) that positions the selected light in azimuth and elevation. The remote light/receiving unit (50) includes azimuth and elevation motors (64) (68) that are mechanically linked to the light (72), and a light power controller (70) that applies power to the light. In a typical situation, a remote light/receiving unit (50) would be attached to each upper corner of a structure and each unit (50) would be connected to the utility power line. The master control/transmitting unit (12) is then plugged into any utility power receptacle in any room; and by means of the switches (16) (18) and the joystick (20) any of the remote lights (72) can be selected, turned on and positioned.

U.S. Pat. No. 5,506,715

Inventor: Joshua S. Zhu

Issued: Apr. 9, 1996

A lighting system having an electric lamp controlled by an infrared remote controller is disclosed. The remote controller incorporates a commercially available transmitter and receiver which reliably functions in the presence of infrared noise having frequencies at and about the carrier frequency of the transmitted signal. The remote controller receiver outputs a demodulated signal and a filter acts on the demodulated signal to remove noise present in the demodulated signal caused by the electric lamp by comparing measured time intervals between leading and trailing edges of the demodulated signal to predetermined values defining data elements.

U.S. Pat. No. 5,584,560

Inventor: Earl W. Gosswiller, et al.

Issued: Dec. 17, 1996

A spotlight is provided that employs stationary motors for positioning a light beam at a desired azimuth and elevation such that there are no blind spots of the light beam at the zenith of the azimuth and elevation. A drive train rotates the spotlight about a horizontal axis and allows the motor driving the rotation to have a stationary mounting in a base while at the same time providing the light beam of the spotlight with a range of elevation that exceeds 90 degrees from a horizontal reference plane at any desired azimuth. More particularly, a stationary motor drives a capstan, which includes a spool that winds and unwinds a cable connected to a lamp assembly of the spotlight for positioning the light beam at a desired elevation. The cable is communicated between the lamp assembly and the capstan by way of a central bore in a mast that supports the lamp assembly for rotation about a vertical axis.

U. K. Patent Number GB 2 177817 A

Inventor: Marcello Bertozzi

Issued: 12 Jul. 1985

Apparatus for remotely controlling position, focusing etc. of theatre lighting apparatus has command input generators (e.g., potentiometers) which emit commands proportional to their movement. The commands may be transmitted by radio to the lighting apparatus.

U.S. Pat. No. 1,300,109

Inventor: Danny C. Jones

Issued: 5 May 1992

A remote controlled spotlight system having a pair of spotlights on the ends of a horizontal shaft extending through a housing is disclosed. A vertical shaft extends out of the housing for mounting purposes. An electric motor in the housing rotates the horizontal shaft about its longitudinal axis to aim the spotlights up or down. A second electric motor in the housing rotates the housing about the longitudinal axis of the vertical shaft to aim the spotlights left or right. The electrical motors are remotely controlled. An electrical power cord extends through the bore of the horizontal shaft, and winds around the horizontal shaft at least twice. The cord then winds around the vertical shaft at least twice, and then passes through the bore of the vertical shaft to a power source.

While these remote control devices for adjusting spotlights may be suitable for the purposes for which they were designed, they would not be as suitable for the purposes of the present invention, as hereinafter described.

SUMMARY OF THE PRESENT INVENTION

The present invention discloses a remote control device for spotlights and a means for retrofitting a remote control device to an existing light fixture for repositioning the horizontal and vertical axis of a standard stage lighting fixture such as a par can, a Fresnels, an ellipsoidal and the like. The present invention permits the user to make such adjustments from a remote location at any time either before or during a performance. Each unit may include a remote control device that sends a unique data signal to which that specific light will respond or the present invention may be adapted so that one remote control device effects a plurality of lights simultaneously. A vertical drive mechanism will control the vertical movement of the lamp and a horizontal drive mechanism will control the horizontal movement of the lamp. Both the vertical and horizontal drive mechanisms have receivers for receiving the transmitted signal from the remote control.

A primary object of the present invention is to provide a means for retrofitting existing stage lights, such as par cans, Fresnels, ellipsoidals and the like, with a remote control device for adjusting the projection angle of the light emitted by the lamp.

Another object of the present invention is to provide a means for retrofitting stage lights with a remote control device requiring minimal modifications to the casing of said stage light.

Yet another object of the present invention is to provide a means for retrofitting stage lights with a remote control device that can precisely reposition the angle of projection along both the horizontal axis and the vertical axis.

Still another object of the present invention is to provide a means for retrofitting stage lights with a remote control device to allow the repositioning thereof at any time prior to and during a performance.

Still yet another object of the present invention is to provide a means for retrofitting stage lights with a remote control device that can reposition a plurality of stage lights with a single command.

Yet another object of the present invention is to provide a means for retrofitting stage lights with a remote control device that is simple and easy to use.

Still yet another object of the present invention is to provide a means for retrofitting stage lights with a remote control device that is inexpensive to manufacture and operate.

Additional objects of the present invention will appear as the description proceeds.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
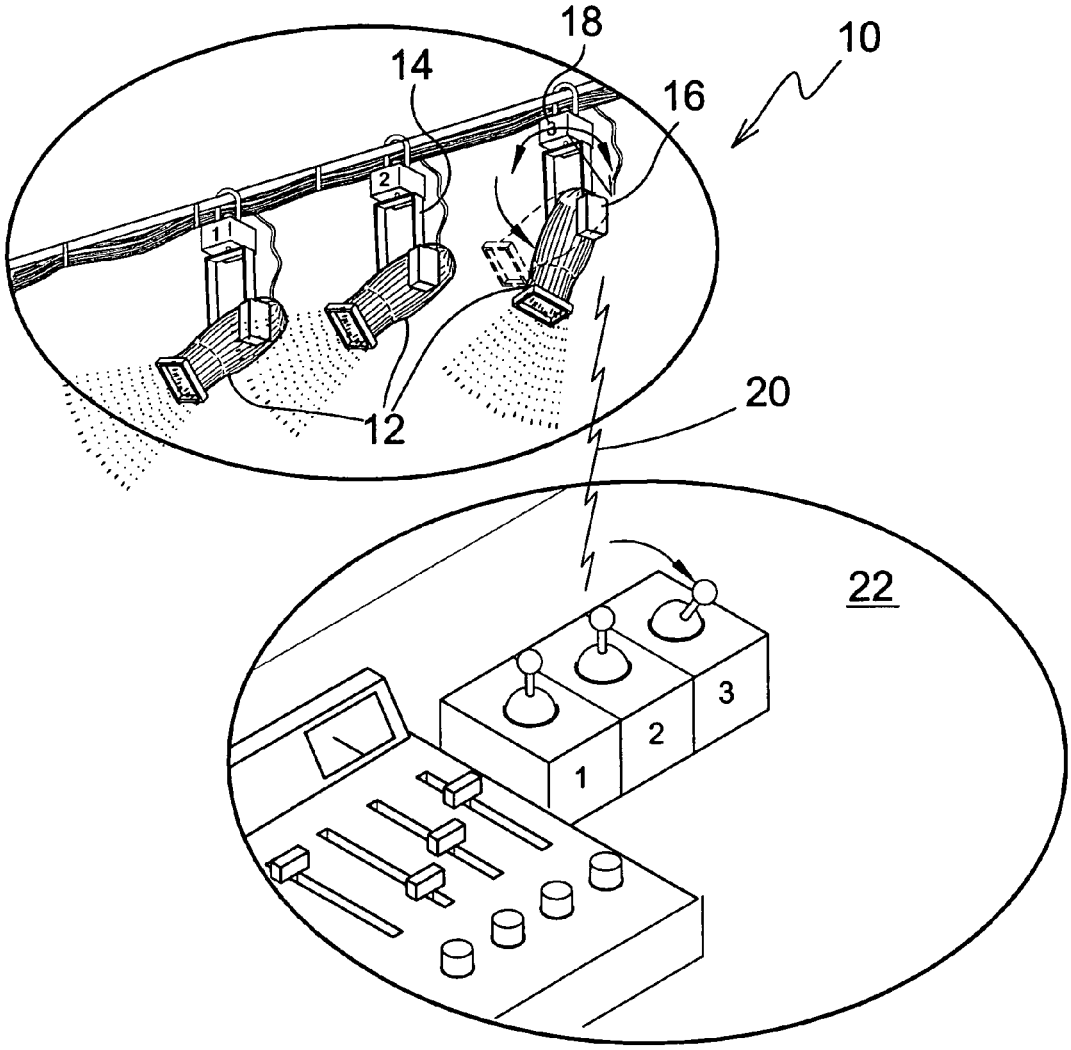
FIG. 1 is an illustrative view of the present invention in use.

With regard to reference numerals used, the following numbering is used throughout the drawings.

10 present invention
12 stage lights
14 U-bracket
16 vertical motor
18 horizontal motor
20 data signal
22 remote control unit
24 lamp
26 C-clamp
28 receiver
30 microprocessor
32 vertical drive mechanism
34 gear
36 worm drive
38 lamp housing

40 bolt head
42 bolt housing
44 gear spacer
46 retaining screw
48 retaining pins
50 retaining screw recess
52 bolt recess
54 retaining screw nut
56 retaining pin recess
58 to vertical motor
60 horizontal rotation unit
62 directional control
64 transmitter
66 holes

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention is a remote control device to be retrofitted to existing stage lights 12 such as ellipsoidals, Fresnels, par cans and the like. The present invention 10 allows a lighting technician to adjust the angle of lights 12 from a remote location. The present invention 10 comprises a u-bracket 14 similar to those used for existing lights that has a motor to control the vertical rotation 16 of the light and a motor to control the horizontal rotation 18, a receiver to receive a data signal 20, a microprocessor to process the data signal and a remote control unit 22 with transmitter to send a data signal which may be a radio frequency signal.

Figure 2:
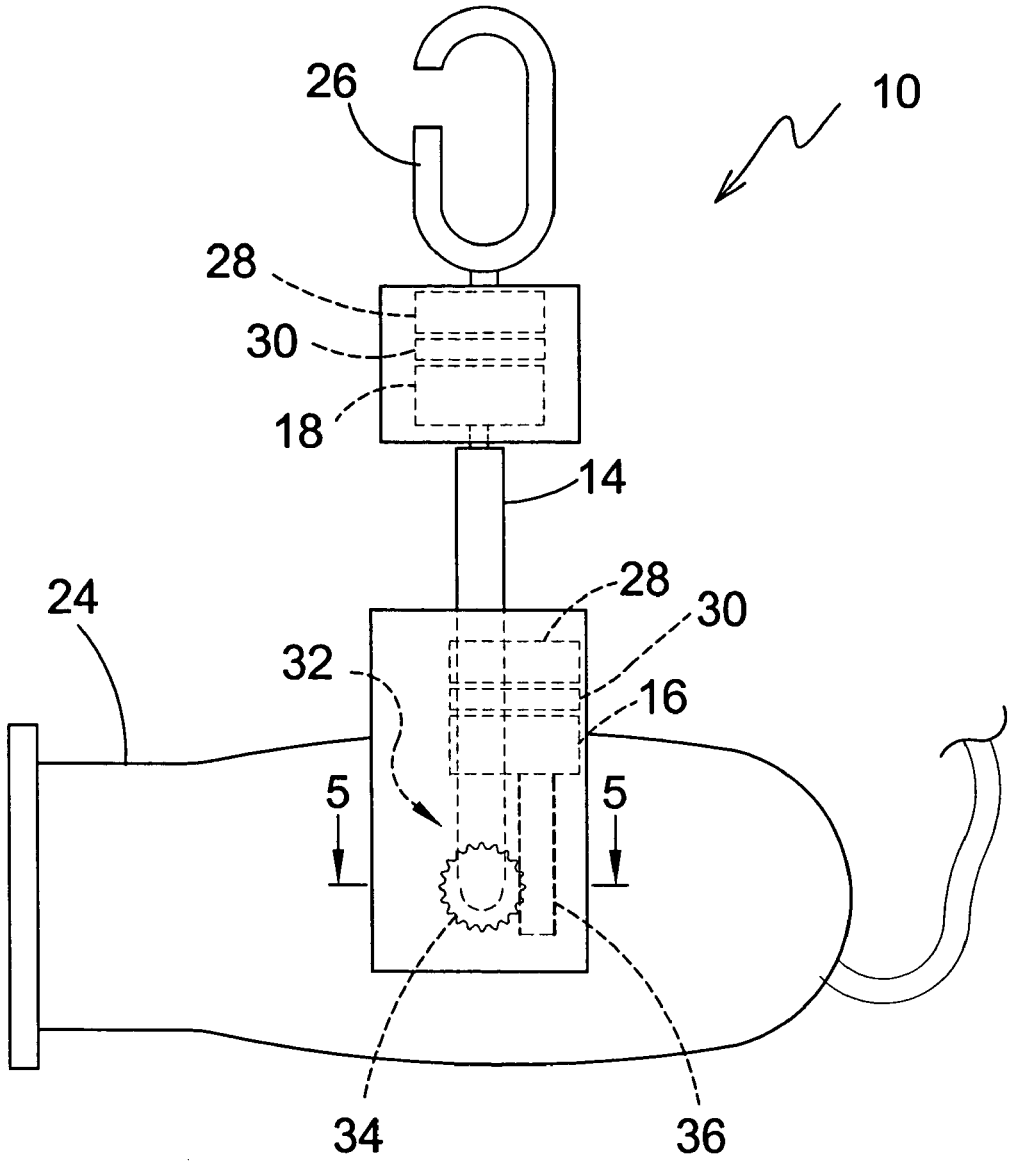
FIG. 2 is a side view of the present invention in use.

Turning to FIG. 2, shown therein is a side view of the present invention 10 in use. Shown is the present invention 10 mounted to a conventional ellipsoidal lamp 24 to convert it to a remote adjustable light. The primary components are mounted on a u-bracket 14 and are shown in hidden line. Shown are a C-clamp 26 or like member for attachment to a structure, a pair of receivers 28 and microprocessors 30 for the vertical 16 and horizontal 18 motors, and a vertical drive mechanism 32 which includes a worm gear 34 and worm drive 36.

Figure 3:
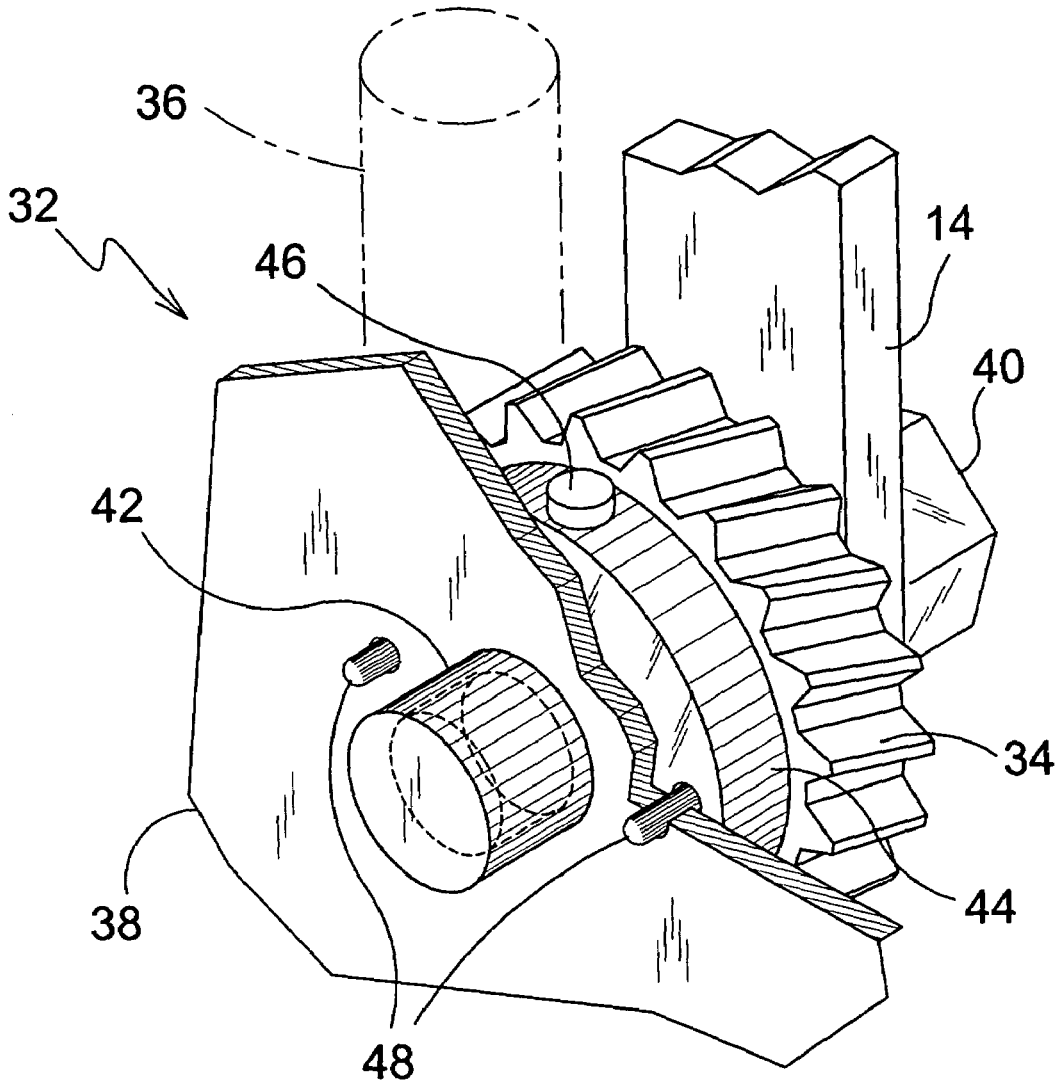
FIG. 3 is a sectional perspective view of the vertical drive mechanism of the present invention.

Turning to FIG. 3, shown therein is a sectional perspective view of the vertical drive mechanism 32 of the present invention. Shown is the vertical drive mechanism 32 of the present invention wherein a gear 34 (sometimes referred to herein as a worm gear) rotates in accordance to the rotation direction of the worm drive 36 driven by the vertical motor so as to rotate the lamp housing 38 vertically. The vertical motor works in conjunction with the horizontal motor to allow the operator to direct the light from the lamp in a specific direction from a remote location. Also shown are the U-bracket 14, lamp housing 38, head of bolt 40 and bolt housing 42, gear spacer 44, and retaining screw 46 and retaining pins 48.

Figure 4:
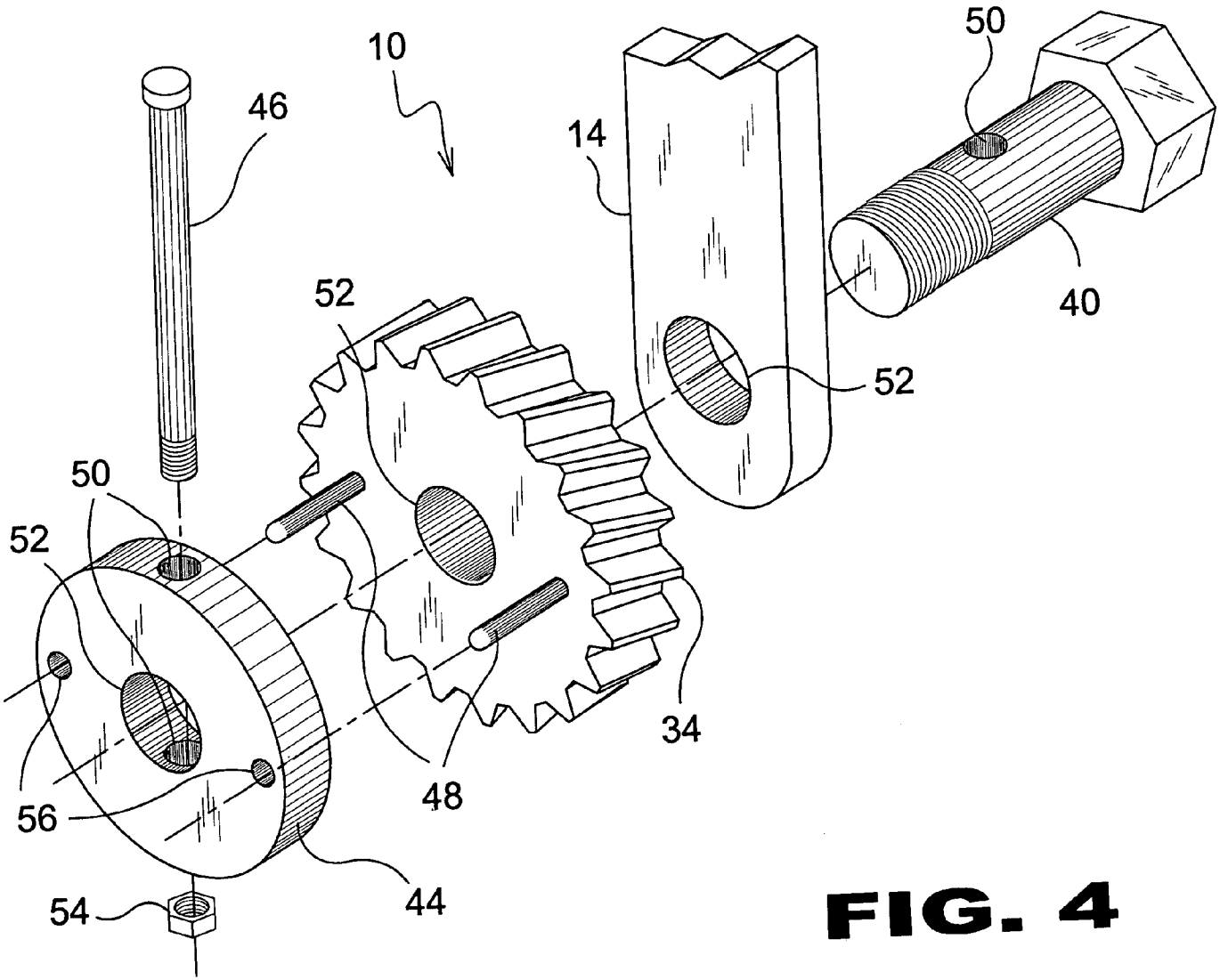
FIG. 4 is an exploded view of the vertical drive mechanism of the present invention.

Turning to FIG. 4, shown therein is an exploded perspective view of the vertical drive mechanism 32 of the present invention. Shown are the components of the vertical drive mechanism 32. The spacing element 44 with central aperture serves to keep the worm gear 34 with central aperture from contacting the lamp housing and locks the bolt 40 to the assembly. Furthermore, the spacing element 44 may be used as a template when drilling the retaining pin holes in the lamp housing to assure the accurate alignment thereof. Also shown are the U-bracket 14, retaining screw 46 with nut 54 with transverse recess 50, bolt recess 52, perpendicular retaining pins 48 and a pair of retaining pin recesses 56 disposed between the central aperture 52 and the periphery of the spacer 44. Retaining screw 46 has a head and a threaded end with a nut 54 and extends thru the vertical recess 50 of spacer 44 from one peripheral side to the other peripheral side and through recess 50 of bolt 40.

Figure 5:
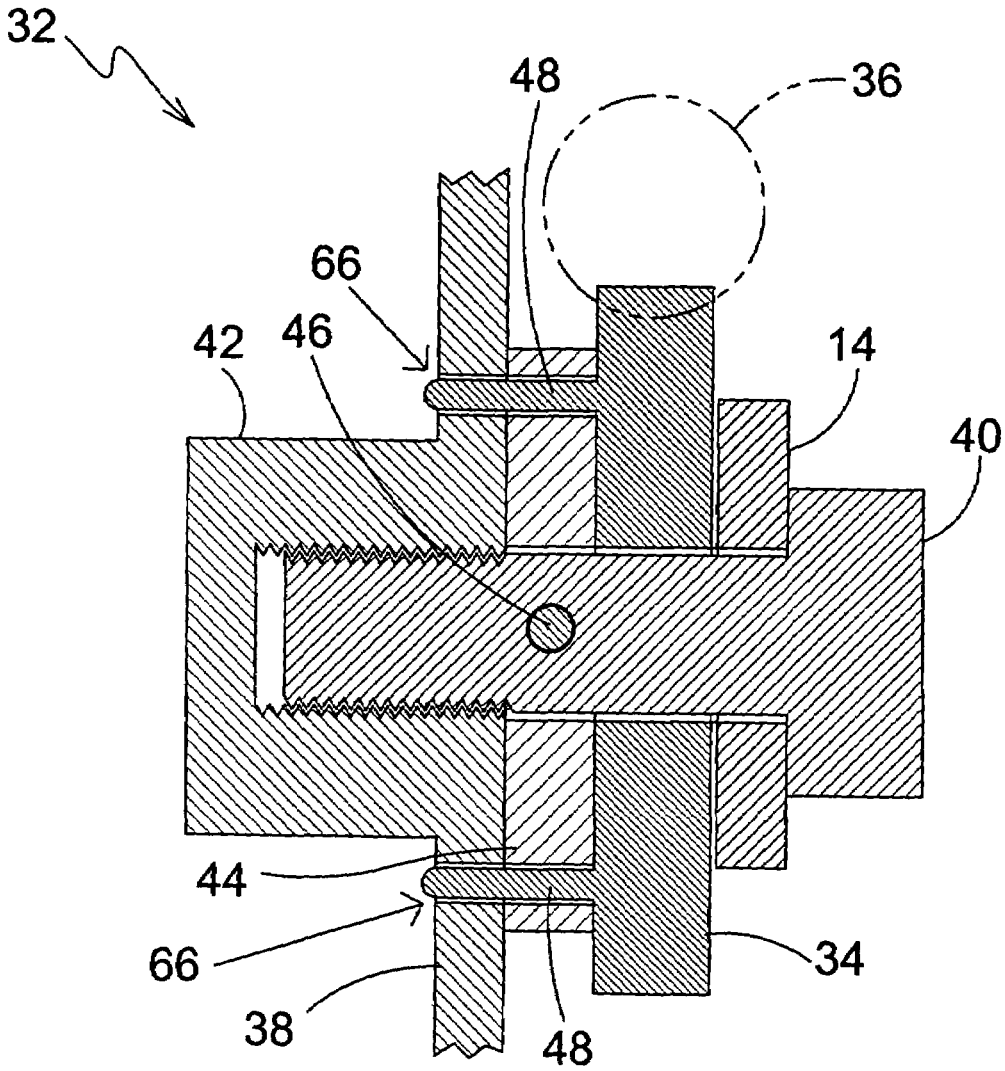
FIG. 5 is a sectional top view of the vertical drive mechanism of the present invention.

Turning to FIG. 5, shown therein is a sectional top view of the vertical drive mechanism 32 of the present invention. The vertical drive mechanism 32 of the present invention is designed to lock the lamp housing 38 to the worm gear 34 with retaining pins 48 extending from the worm gear into corresponding holes 66 drilled into the lamp housing 38 so the rotation of the worm gear 34 by worm drive 36 will turn the lamp housing 38 accordingly without allowing the bolt 40 to withdraw. Drilling the holes into the lamp housing 38 is the only modification that is required to retrofit the present invention thereto. The rotation of the worm drive 36 turns the worm gear 34 and the associated lamp housing 38 in the appropriate direction according to the data signal received from the remote control unit. Also shown are the U-bracket 14, spacer 44, bolt housing 42 and retaining screw 46.

Figure 6:
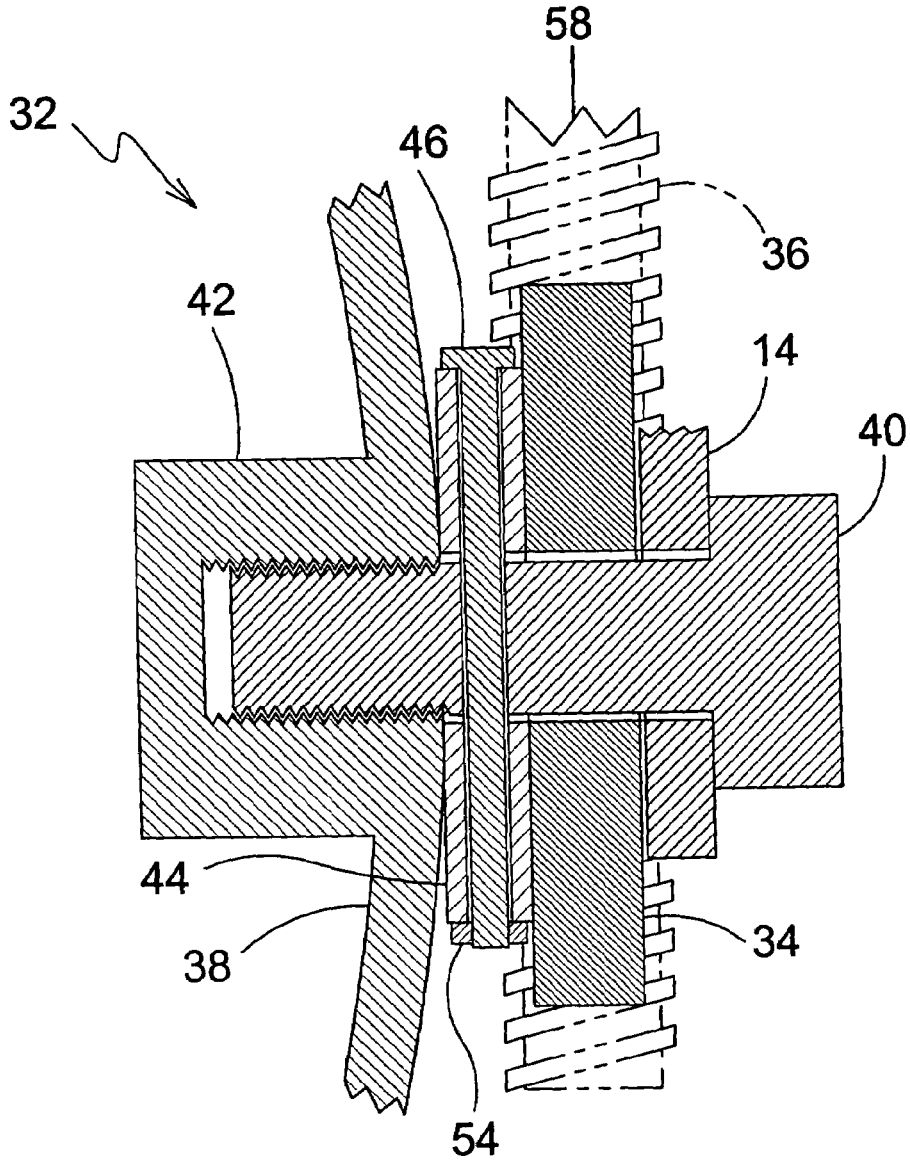
FIG. 6 is a sectional side view of the vertical drive mechanism of the present invention.

Turning to FIG. 6, shown therein is a sectional side view of the vertical drive mechanism 32 of the present invention. A retaining screw 46 passing through the spacer element 44 and the bolt 40 which assures that the bolt will rotate along with the bolt housing 42 thereby preventing the unthreading thereof. The direction to the vertical motor is shown at 58. Bolt 40 extends through the u-bracket, the gear 34, the spacer 44 and the lamp housing 38 and into the bolt housing 42 to secure all of these elements together. Other previous disclosed elements are also shown.

Figure 7:
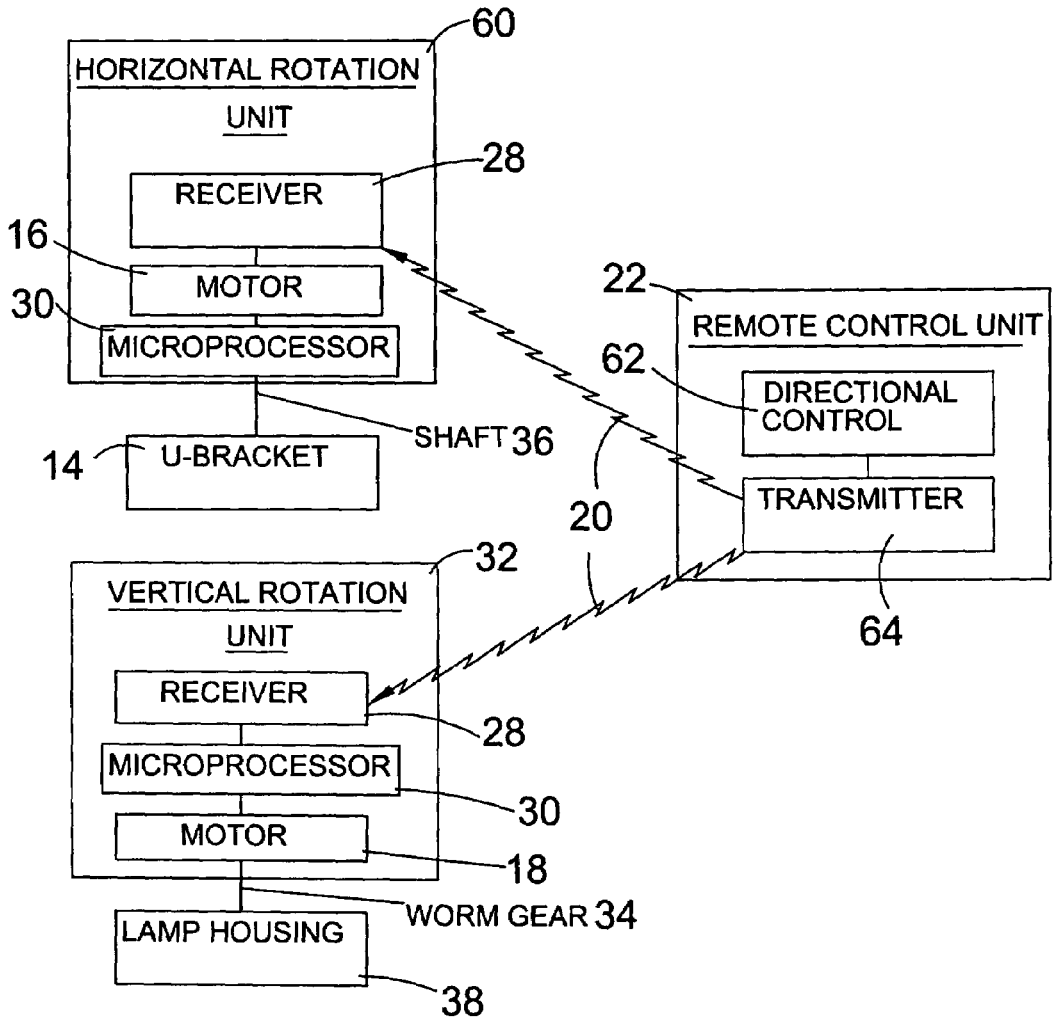
FIG. 7 is a block diagram of the present invention.

Turning to FIG. 7, shown therein is a block diagram of the present invention in use. Shown are the operational relationships of the primary components of the present invention. Included are horizontal rotation unit 60 with receiver 28, microprocessor 30, motor 16, drive shaft 36 and U-bracket 14. Also shown are vertical rotation unit 32 with receiver 28, microprocessor 30, motor 18, worm gear 34 and lamp housing 38. Also shown are the remote control unit 22, directional control 62 and transmitter 64 and signal 20.

I claim:

1. An apparatus for remotely controlling the movement of a stage light, comprising:

a) a light having a housing, said housing having an inside and an outside and a pair of sides;

b) a U-bracket having opposing arms and a base, wherein said opposing arms of said bracket are downwardly disposed, wherein said sides of said housing are disposed between said arms of said U-bracket;

c) means for horizontally rotating said light being disposed on said base of said U-bracket whereby the light is rotated in the horizontal plane;

d) a member being disposed on said means for horizontal rotation to permit the light to be attached to a structure;

e) means for vertically rotating said lights being disposed on one of said arms of said U-bracket whereby the light is rotated in the vertical plane; and, f) means for remotely controlling said means for horizontally rotating said light and said means for vertically rotating said light whereby the horizontal and vertical rotation of the light is remotely controlled, wherein said means for vertically rotating said light comprises:

i) a second motor having an output shaft, wherein said shaft comprises a worm drive;

ii) a second receiver disposed adjacent said second motor for receiving a transmitted signal to permit the second motor to be controlled;

iii) a second microprocessor disposed adjacent said second motor for processing a signal to permit the second motor to be controlled;

iv) a gear being driven by said worm drive, said gear moving in response to said worm drive, said gear having a central gear aperture therein, said gear having an inside and an outside; and v) means for attaching said gear to said arm of said U-bracket and to said housing of said light whereby the light is rotated in the vertical plane by the second motor and said means for attaching said gear to said arm of said U-bracket and to said housing of said light, comprise i) wherein said arm of said U-bracket has a bolt aperture therein and an inside and an outside;

ii) a spacer being disposed between said inside of said gear and said outside of said light housing, said spacer having a central horizontal spacer aperture therein, said spacer having an additional pair of horizontal pin apertures disposed therein, wherein said pin apertures are disposed between said central spacer aperture and the periphery of said spacer, said spacer having an additional vertical aperture therein, wherein said vertical aperture runs from one peripheral edge of said spacer to a second opposite peripheral edge of said spacer;

iii) wherein said housing of said light has a first aperture therein and an additional pair of adjacent apertures therein, wherein said additional pair of adjacent apertures are co-aligned with said additional pair of horizontal pin apertures in said spacer;

iv) a pair of retaining pins being substantially perpendicularly disposed on said inside of said gear, wherein said retaining pins pass through said additional pair of horizontal pin apertures in said spacer, wherein said retaining pins pass through said additional pair of adjacent aperture disposed in said housing of said light, wherein said housing of said light turns as said gear turns to permit the light to be rotated in the vertical plane;

v) a holt having a threaded end and a head, wherein said holt passes through said bolt aperture in said U-bracket and said central gear aperture and said central horizontal spacer aperture and said first aperture in said housing of said light so that said head is disposed on said outside of said U-bracket and said threaded end is disposed on said inside of said housing of said light wherein said holt has a transverse aperture therein;

vi) a bolt housing being internally threaded being disposed on said inside of said housing of said light, wherein said threaded end of said bolt is threaded into said bolt housing so that said U-bracket and said gear and said spacer and said housing of said light are secured together; and, vii) a retaining screw having a threaded end and a head, wherein said crew passes through said additional vertical aperture of said spacer and said transverse aperture in said holt wherein said retaining screw passes from one peripheral edge of said spacer to said second opposite peripheral edge of said spacer, further comprising a nut being attached to said threaded end of said retaining screw to permit the spacer to be secured to the bolt to prevent the bolt from becoming unscrewed from the bolt housing.

2. The apparatus of claim 1, wherein said means for horizontally rotating said light comprises:

a) a first motor having an output shaft thereon, wherein said shaft is substantially upright standing and rotates substantially in the horizontal plane, wherein said shaft connects to said base of said U-bracket so that said bracket is horizontally rotated as said shaft rotates;

b) a first receiver disposed adjacent said first motor for receiving a transmitted signal to permit the first motor to be controlled; and, c) a first microprocessor disposed adjacent said first motor for processing a signal to permit the first motor to be controlled.

3. The apparatus of claim 2, wherein said member comprises a C-clamp to permit the light to be attached to a structure.

4. The apparatus of claim 1, wherein said means for remotely controlling said means for horizontally rotating said light and said means for vertically rotating said light comprises:

a) a transmitter for sending a signal to said first and second receivers for controlling said first and second motors; and, b) directional controllers to permit the directional movement of the lights to be selected by a user.

5. The apparatus of claim 4, wherein said signals from said transmitter are unique signals for each said light to permit a single light to respond to the signal.

6. The apparatus of claim 5, wherein said signals from said transmitter are unique signals for a plurality of said lights to permit a plurality of said lights to respond to the signal.

7. The apparatus of claim 6, wherein said housing of said light is an ellipsoidal housing.

8. The apparatus of claim 7, wherein said housing of said light is a Fresnel housing.

9. The apparatus of claim 8, wherein said housing of said light is a par can housing.

10. The apparatus of claim 9, wherein said signals from said transmitter are radio frequency signals.

* * * * *